US007644824B2

(12) United States Patent
Hollyfield et al.

(10) Patent No.: US 7,644,824 B2
(45) Date of Patent: Jan. 12, 2010

(54) TENSION INDICATING SCREEN MOUNTING APPARATUS FOR VIBRATING SEPARATORS

(75) Inventors: Clifford G. Hollyfield, Cumming, GA (US); Alan S. Jackson, Atlanta, GA (US)

(73) Assignee: J & H Equipment, Inc., Roswell, GA (US)

( * ) Notice: Subject to any disclaimer, the term of this patent is extended or adjusted under 35 U.S.C. 154(b) by 448 days.

(21) Appl. No.: 11/360,655

(22) Filed: Feb. 23, 2006

(65) Prior Publication Data

US 2007/0193928 A1 Aug. 23, 2007

(51) Int. Cl.
*B07B 1/49* (2006.01)

(52) U.S. Cl. ..... 209/405; 209/403

(58) Field of Classification Search ..... 209/403, 209/405; 73/862.471, 862.472
See application file for complete search history.

(56) References Cited

U.S. PATENT DOCUMENTS 2,812,062 A * 11/1957 Hannon ..... 209/238
4,148,724 A * 4/1979 Hannon ..... 209/403
4,274,953 A * 6/1981 Jackson ..... 209/326
5,199,574 A * 4/1993 Hollyfield et al. ..... 209/315
6,520,341 B2 * 2/2003 Suter et al. ..... 209/405
6,575,304 B2 * 6/2003 Cudahy ..... 209/365.3
6,659,286 B2 * 12/2003 Seyffert et al. ..... 209/405
2002/0153289 A1 * 10/2002 Suter et al. ..... 209/405
2003/0066786 A1 * 4/2003 Seyffert et al. ..... 209/405

OTHER PUBLICATIONS

"CUPOL: How to use the vernier caliper" http://phoenix.phys.clemson.edu/labs/cupol/vernier/index.html Jan. 26, 2006.*
"Caliper" Dictionary.com Unabridged (v 1.1) Based on the Random House Unabridged Dictionary, © Random House, Inc. 2006.*

* cited by examiner

*Primary Examiner*—Patrick H Mackey
*Assistant Examiner*—Kalyanavenkateshware Kumar
(74) *Attorney, Agent, or Firm*—Stephen D. Carver

(57) ABSTRACT

Screen separators and a screen tensioning system for separators that facilitates rapid measurement of screen tension. Each separator subframe screen is suspended between opposed subframe walls. Suitable linkages distribute vibration during the aggregate sifting process. Screen edge flanges are secured by tensioners that control a screen suspension bracket. A carriage bolt fitted through bracket orifices and the walls coaxially receive a resilient grommet captivated by an adjustable sleeve nut. As the nut is tightened, screen tension increases and the grommet diameter increases. A portable gauge with an internal U-shaped measurement sleeve is fitted over the deformed grommet to measure screen tension. A plurality of gauge calibration points bordering the deformed grommet determine applied screen tension.

3 Claims, 10 Drawing Sheets

TENSION INDICATING SCREEN MOUNTING APPARATUS FOR VIBRATING SEPARATORS

BACKGROUND OF THE INVENTION

1. Field of the Invention

The present invention relates generally to vibrating screen separators for processing commingled mixtures and separating and assorting their solid constituents. More particularly, the present invention relates to separator screen machines, and to methods and apparatus for adjustably tensioning the vibrating screens they use for sifting and separating aggregates.

2. Description of the Related Art

Numerous screen separator devices are known in the art for processing commingled mixtures. With machinery of this nature, aggregates of various desired sizes are separated from differently sized portions of an incoming raw mixture. Typical separator devices are associated with suitable bulk handling equipment, including chutes, conveyors and the like, that deliver raw material to the separator, and thereafter transfer separated constituent elements away from the separator stages for further processing or storage or shipment. Screen separators designs involve multiple generally planar, screens that are mounted on subframes and vibrated during operation. Screens or groups of screens may be stacked vertically, or arranged serially in a processing plant. Elements of materials traversing the vibrating screens gravitationally drop below for further collection and processing. Numerous successive screening steps are often accomplished with laterally adjacent or vertically stacked screen decks. Typically the separator screens are tightly mounted and supported within an encircling subframe that is secured to the machine framework. Vigorous agitation in the form of screen vibration and/or oscillation is imparted through a variety of different mechanical systems causes material movement and enhances the separation effects.

Prior art vibrating screen separators are seen in prior U.S. Pat. No. 4,274,953, issued Jun. 23, 1981, and U.S. Pat. No. 5,199,574 issued Apr. 6, 1993, both of which are entitled "Vibrating Screen Separator." Both of these patents are assigned to J & H Equipment, Inc., the instant assignee. The latter reference discloses a vibrating screen separator having a generally planar sifting screen that is forcibly vibrated. The separator may be configured with stacked decks and serially connected sections involving multiple sifting planes. In the latter patent reference, the emphasis was upon a means of tuning the interconnecting vibratory apparatus for maximum sifting effects by optimizing vibrational energy control. In the separator sheets, cloth is tensioned between subframe sides by mounting rails that are tightened by eye nuts externally accessible at the sides of the frame. Material gravitationally flows over the vibrating screens towards a discharge position. The screen cloth is shaken by an elongated, center strip that is oscillated by a vibrator drive system.

Vibrating screen separators are subject to continuous wear and tear during operation. The screen sections must be mounted tightly in proper alignment. Screen tension is controlled by the multiple peripheral eye nuts or mounting hardware that surrounds the subframe. Adjustments are required periodically, and during routine maintenance or the replacement of screen sheets, the multiple eye nuts must be tediously inspected and adjusted to insure proper operational tension. No simple means for simply and quickly measuring screen tension has hitherto been available.

A system for easily maintaining proper screen tension with a minimum of operator effort is desirable. An adequate screen tensioning system should be quickly and easily adjustable, and means must be provided enabling an operator to quickly discern the setting of the tensioning hardware. A screen separator having tensioning elements whose settings can be readily determined visually, for example, would significantly ease the maintenance and operation burdens imposed upon the machine operators.

BRIEF SUMMARY OF THE INVENTION

Our invention provides an improved screen separator, and an improved tensioning system for securing and stretching separator screens used for material processing. The preferred tensioning system provide a highly visibly and easily measured indication of screen tension.

A preferred separator has at least one separator subframe comprising a screen that is adapted to be tensioned between a pair of subframe walls. Suitable vibrations are transmitted through appropriate linkages to distribute vibration. Relatively large aggregates that cannot drop through the screen travel across it to a laterally spaced-apart delivery point, and those particles dropping through it gravitationally can be recovered below, or can be conveyed by lower screens to an appropriate remote location for offloading.

Each generally rectangular screen subframe comprises a pair of rigid, spaced apart walls that receive and secure outer edges of the sifting screens. Each screen is mounted along its ends to opposite, internal surfaces of the subframe walls by a plurality of spaced apart tensioners that engage conventional screen edge flanges known in the art. The tensioning system preferably comprises a one-piece suspension bracket on inner subframe walls. The preferred bracket preferably has a planar, apertured center integral with a lower foot and an arm that angles upwardly away from the center. The bracket foot is coupled to the screen edge flange for imparting screen tension.

Each tensioner is secured by a suitable fastener, preferably an elongated carriage bolt, that is fitted through suitable bracket orifices and, aligned orifices in the subframe walls. The carriage bolt shank coaxially mounts a resilient grommet that is captivated by a washer and sleeve nut threadably coupled to the carriage bolt end. As the sleeve nut is tightened, screen tension increases. Concurrently, the resilient grommet is compressed and deformed, so that its diameter increases. Grommet diameter is directly related to applied screen tension.

A portable gauge adapted to be fitted around the grommet quickly and easily measures screen tension. The gauge has a pair of legs disposed on opposite sides of an elongated, U-shaped measurement channel that decreases in width towards the gauge top. A plurality of calibration points are defined along inner leg edges. When the gauge is fitted about a grommet, the grommet slides within the measurement channel until interference prevents further slidable movement. The larger the grommet, and the concomitant compression, the less the grommet can slide within the gauge measurement channel. Calibrations defined upon inner edges of the gauge feet provide a measurement of screen tension by directly measuring grommet diameter changes in response to axial compression.

Thus a basic object of our invention is to provide a system for easily maintaining proper screen tension in screen separators.

Another object is to minimize the amount of time and effort required of screen separator machine operators for maintaining correct screen tension.

A related object is to provide a screen separator tensioning system that is quickly and easily adjusted.

Another important object is to provide a tensioning system of the character described wherein the amount of tension imparted to the screen can be quickly and correctly measured.

It is also an important object to provide a screen tension adjustment system of the character described wherein relatively precision adjustment in screen tension may be readily insured by simple portable and tools.

Another basic object is to provide a screen tensioning system that simplifies the maintenance and service requirements associated with industrial screen separators.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
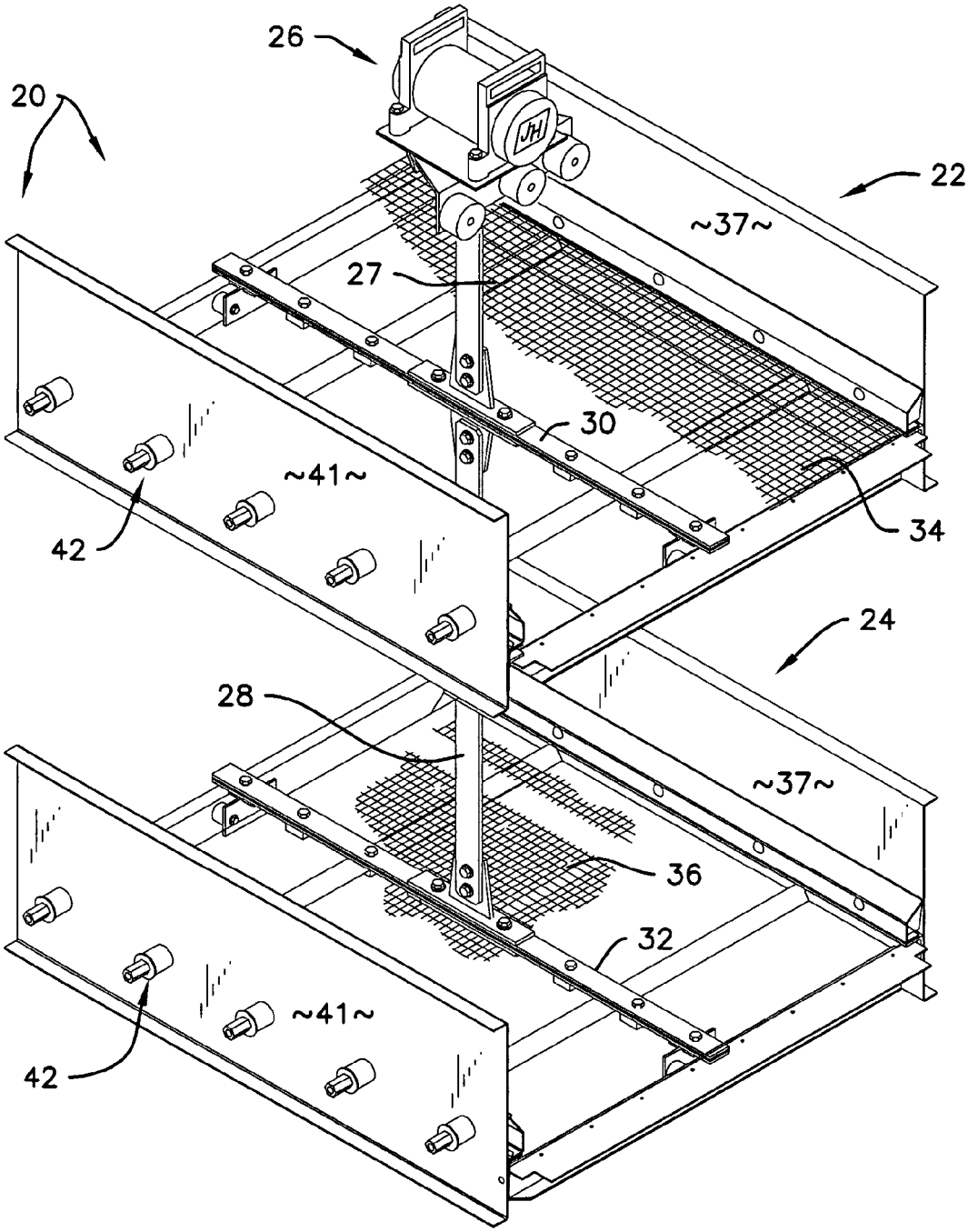
FIG. 1 is an exploded isometric view of a stacked screen separator machine with portions thereof omitted for clarity.
Figure 2:
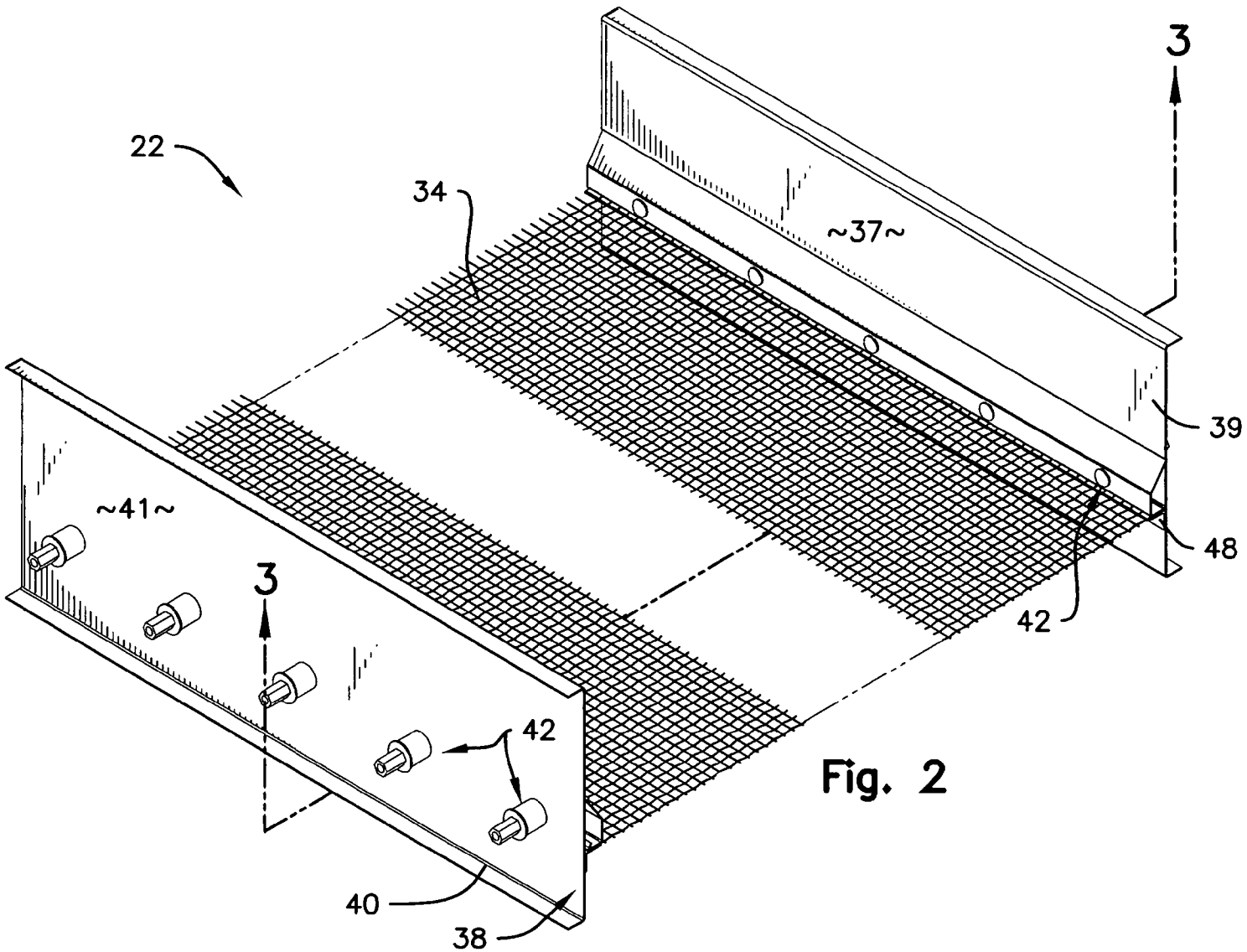
FIG. 2 is an enlarged, fragmentary, isometric view of a single screen separator subframe, showing our tension adjustment system.

With initial reference directed to FIGS. 1 and 2 of the appended drawings, a screen separator constructed generally in accordance with the best mode of the invention has been generally designated by the reference numeral 20. This particular separator uses a pair of vertically stacked, generally rectangular separator subframes 22 and 24. Each subframe is mounted to and deployed upon the separator machine frame and vigorously agitated by a vibrator system 26. Vibrations are transmitted downwardly through linkages 27 and 28 to cross pieces 30, 32 that distribute vibrations to the screens 34, 36. Portions of material traversing the screens are separated, with the larger particles traversing the screens and laterally exiting from upper screen edges, and with smaller aggregates dropping through the screen mesh gravitationally. One or more banks of separator screen assemblies may be laterally used in sequence. However, it will be understood that the invention is not limited to separators with multiple vertically stacked or laterally spaced-apart screens. Fuller design details of vibrating screen separators of this general type are discussed in prior U.S. Pat. No. 4,274,953, issued Jun. 23, 1981, and U.S. Pat. No. 5,199,574 issued Apr. 6, 1993, which, for purposes of disclosure, are hereby incorporated by reference.

Figure 3:
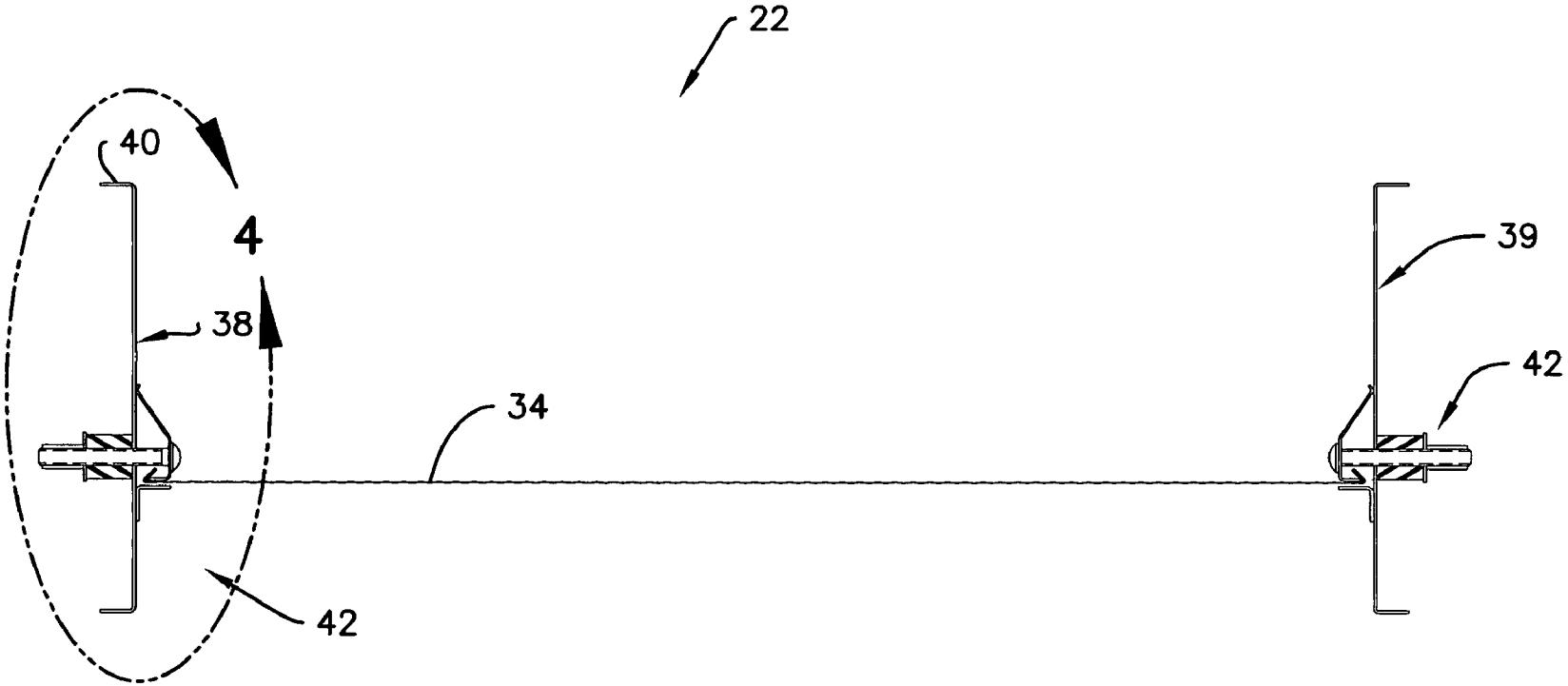
FIG. 3 is an enlarged fragmentary, diagrammatic view taken generally along line 3-3 of FIG. 2.
Figure 4:
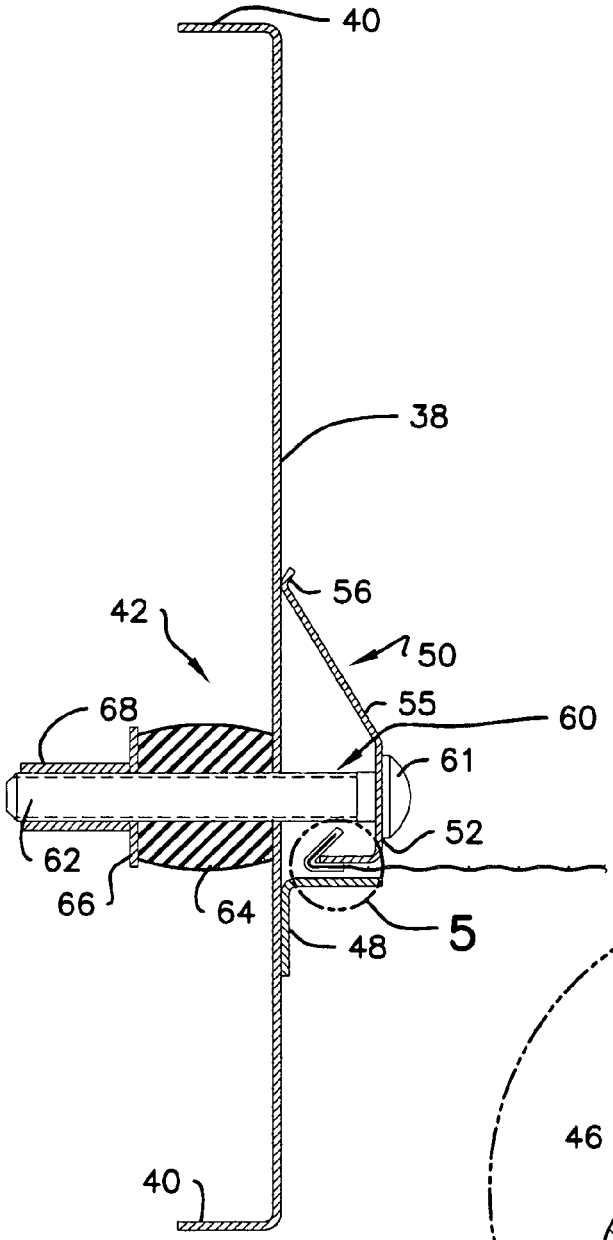
FIG. 4 is an enlarged, sectional view of a preferred tensioner, derived generally from circled region 4 in FIG. 3.
Figure 5:
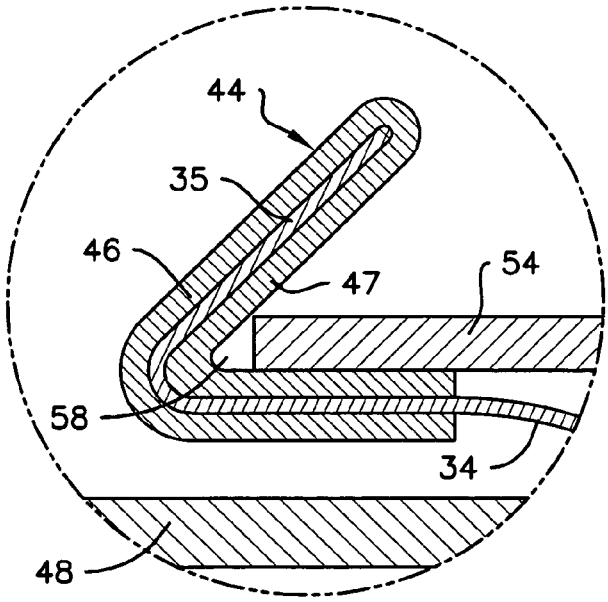
FIG. 5 is an enlarged, sectional view derived generally from circled region 5 in FIG. 4.
Figure 6:
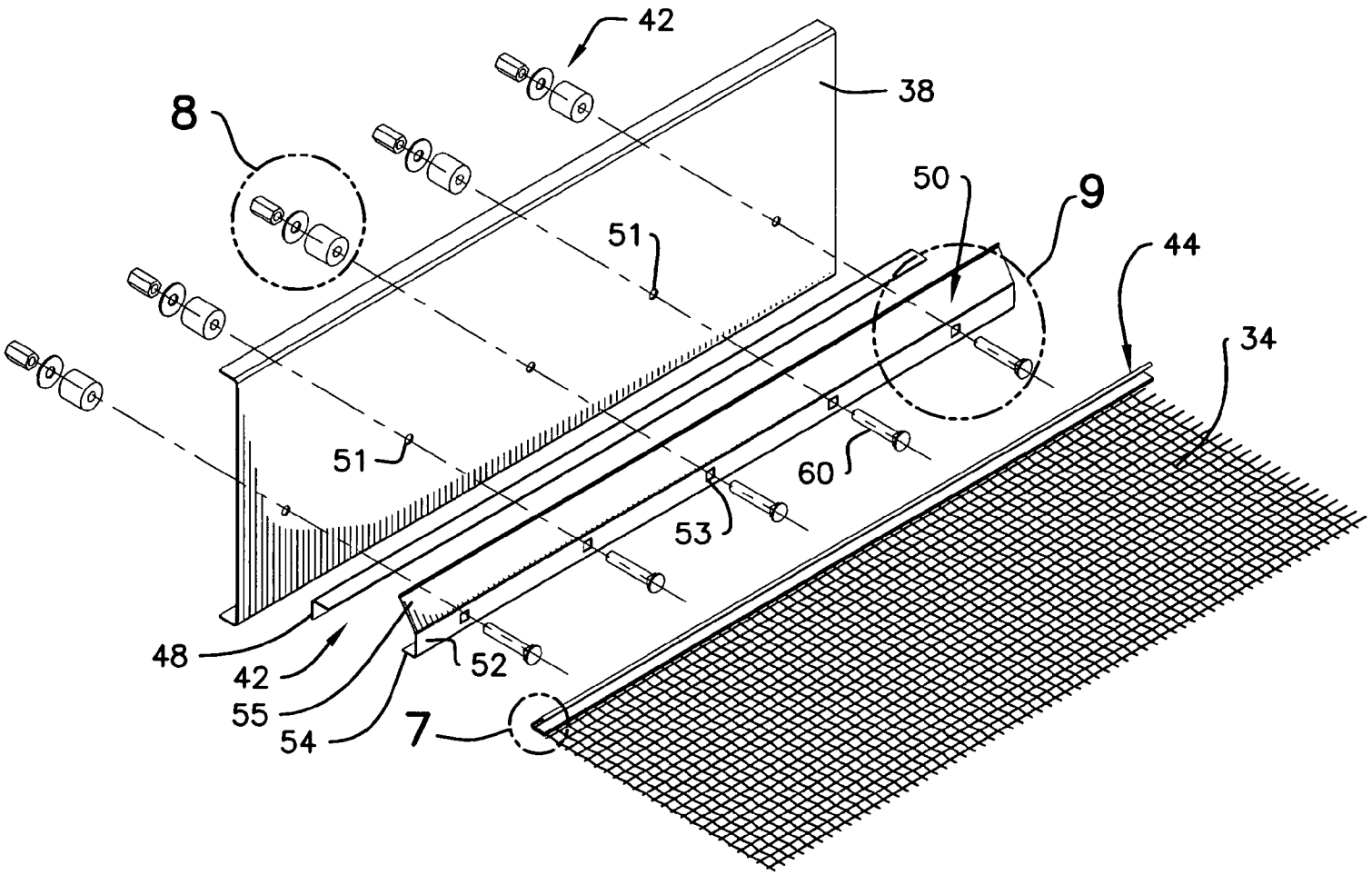
FIG. 6 is an enlarged, fragmentary exploded isometric view of the tensioning system, derived generally from circled region 6 in FIG. 4.
Figure 7:
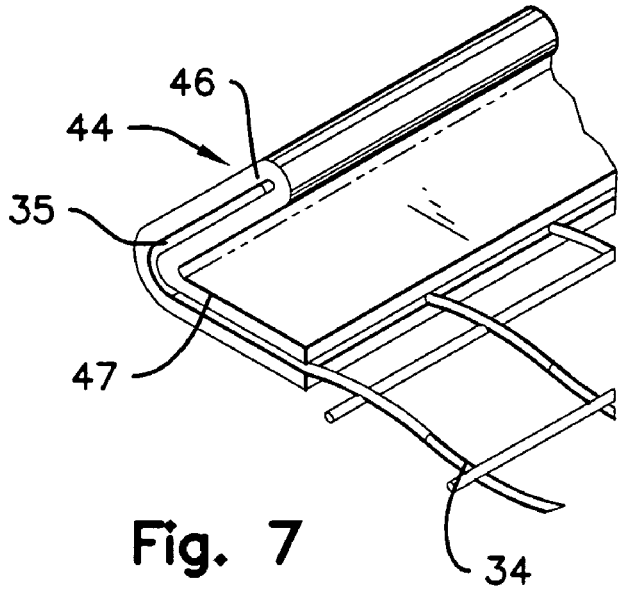
FIGS. 7-9 are enlarged, fragmentary sectional views derived generally from circled regions 7-9 in FIG. 6.

Referencing FIGS. 2-4, each screen subframe 22 comprises a pair of rigid, spaced apart and parallel walls 38, 39 between which the tensioned screen 34 is stretched. Walls 38, 39 include upper and lower flanged ends 40 that facilitate conventional mounting to the machine main frame (not shown). The screen is mounted along its ends to opposite inner surfaces 37 of the subframe walls 38, 39 by numerous spaced apart tensioners 42. Referencing FIGS. 5-7, screen edges are securely fastened to an elongated mounting flange 44 that is mechanically coupled to the tensioner 42. Rigid flange 44 has a generally V-shaped cross section (i.e., FIG. 5). Extreme edges 35 of a screen 34 are received between and compressively sandwiched by flange halves 46 and 47 (FIG. 5). Each flange 44 can be pulled towards a given subframe wall 38 or 39 by a tensioner 42, for stretching and tightening the sifting screens as hereinafter described.

As seen in FIG. 1, numerous spaced apart tensioners 42 serially mounted along the subframe walls 38 have external portions visible along outer subframe wall surfaces 41. Preferably there is an elongated shelf flange 48 running along the inside of the walls 38, 39 immediately below the line of tensioners 42. The cross section of flange 48 is generally L-shaped. During installation of the subframes, flange 48 provides a shelf function to aid in preliminary assembly prior to tensioning. Each of the tensioners 42 is secured inside walls 38 or 39 to an elongated suspension bracket 50 that bears against the internal wall surfaces. While bracket 50 preferably comprises an elongated extrusion, it will be apparent that the bracket function could be accomplished by a plurality of spaced-apart separate bracket elements of the same cross section. Bracket 50 preferably comprises a planar center 52 that is integral with a lower, in-turned foot 54 (FIGS. 5, 6) and an upper, angled arm 55. Center 52 is normally oriented substantially parallel with the walls 38 and 39. There is an integral, curved terminal lip 56 (i.e., FIGS. 4, 9) at the edge of suspension bracket arm 55 that contacts the subframe inner wall surfaces. There are a plurality of spaced-apart orifices 53 defined in bracket center 52 (i.e., FIGS. 6, 9) which register with similar through-holes 51 (FIG. 6) defined in the subframe sides. As best seen in FIG. 5, the lowermost foot 54 of the bracket 50 receives the screen edge flange 44 to control screen tension. Foot 54 is forced within flange vertex 58 (FIG. 5) as the elements are tightened, and it is disposed above and substantially parallel with shelf flange 48 discussed previously.

Figure 8:
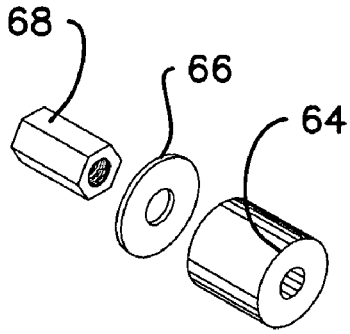
Figure 9:
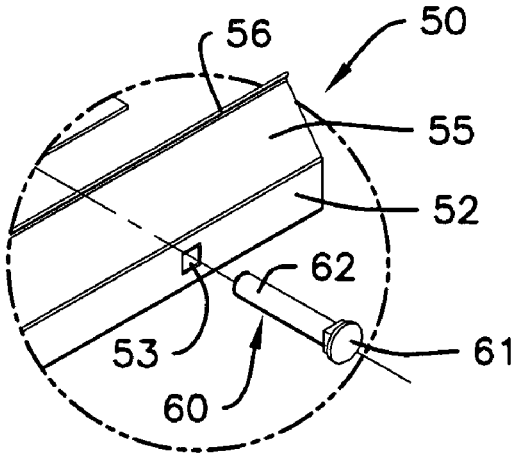

With reference now jointly directed to FIGS. 4, 8, and 9, the tensioners additionally comprise an elongated fastener 60 that is fitted through bracket orifices 53 and side holes 51 in assembly. The preferred fastener 60 is a carriage bolt whose head 61 abuts the planar center 52 of the suspension bracket 50. On the outer side of the subframe walls 38 or 39 the carriage bolt shank 62 penetrates and coaxially secures a resilient grommet 64 that is compressed as tightening increases. As best seen in FIG. 8, a retainer washer 66 that bears against grommet 64 is compressed by tightening of a hex sleeve nut 68.

Screen tightening occurs by turning sleeve nut 68, and as nut tension is increased, screen tensioning follows. Concurrently, with tightening of nut 68 the resilient grommet 64 compresses, and suspension bracket 50 deforms as well. Grommet compression results in both axial and radial deformation. The length of the grommet 64 decreases as tension rises, and concurrently the diameter of the grommet 64 increases. The diameter of the grommet is directly related to the amount of screen tension ultimately effectuated by sleeve nut 68. Grommet diameter changes are visually apparent and easily-measured. Diameter changes are directly related to screen tension.

Figure 16:
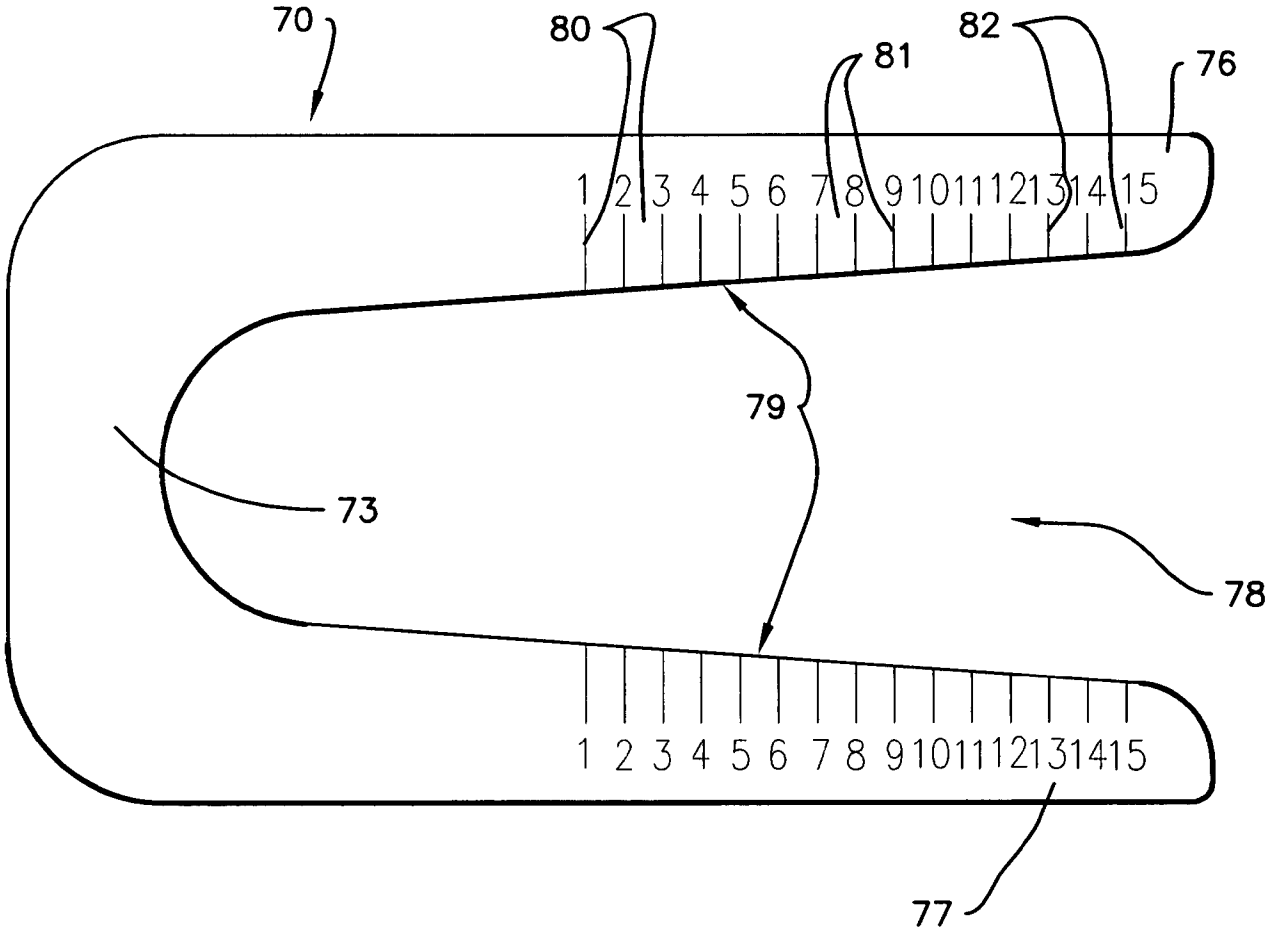
FIG. 16 is an enlarged plan view of the preferred tension gauge.
Figure 17:
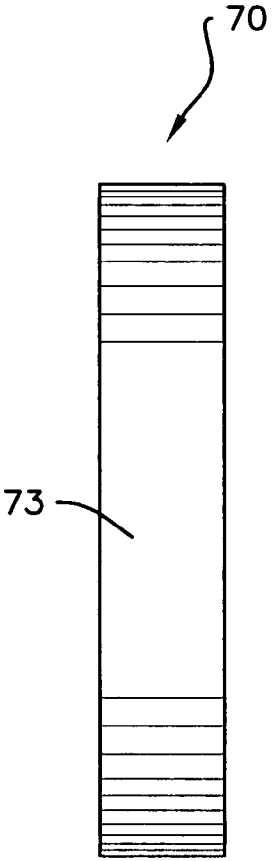
FIG. 17 is a side elevational view of the preferred tension gauge take from a position generally to the left of FIG. 16.

Therefore, a gauge 70 (FIGS. 10-11, 16-17) is proposed for determining screen tension by measuring grommet compression. Gauge 70 is a lightweight metallic, calibrated instrument that can be hand carried. The rigid, preferably metallic or molded plastic body comprises a top 73 that is integral with a pair of projecting, generally parallel and spaced apart legs 76, 77. There is a generally U-shaped void forming a measurement channel 78 between legs 76 and 77. The width of the measurement channel 78 is largest at the bottom of the gauge 70 (i.e., at the right side of FIG. 16), and smallest near the gauge top 73 (i.e., near the left in FIG. 16). As seen, for example, in FIG. 10, the gauge 70 may inserted over the grommet 64 and pressed towards and against it. Gauge legs 76 and 77 will be disposed upon opposite sides of the grommet, and the gauge top 73 will slide towards the grommet as long as adequate clearance exists within measurement channel 78.

Figure 11:
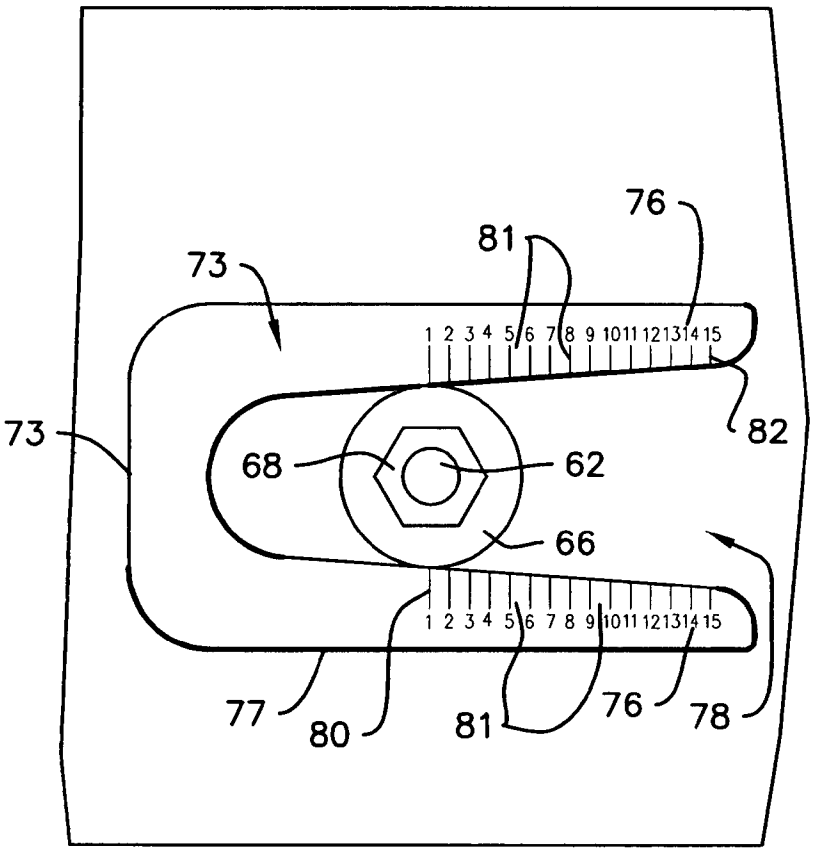
FIG. 11 is a fragmentary plan view taken generally along line 11-11 in FIG. 10.

Opposite inner edges of the gauge feet are preferably indexed or calibrated. For example, there are a plurality of calibrated indexing points 79 (FIG. 13) formed on both inner leg edges. Innermost index points are designated with the reference numeral 80 (FIG. 11). The intermediate index points have been designated with the reference numeral 81, and the outermost index points have been designated with the reference numeral 82. As the gauge 70 surmounts the grommet 64, the diameter of the grommet 64 (which is proportional to applied screen tension) is indicated by the index points 80, 81 and 82. Grommet compression is indicated by those indexing points proximate the grommet center when forced within the measurement channel.

Figure 10:
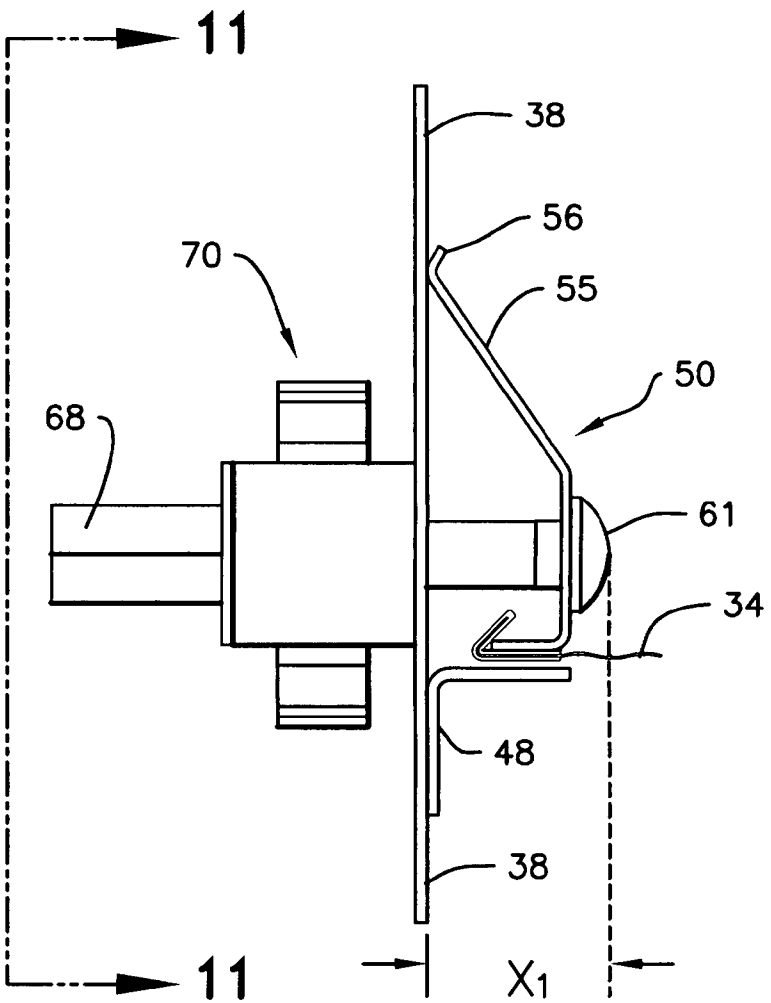
FIG. 10 is an enlarged, fragmentary plan view of a preferred tensioner set to a predetermined screen tension.

In the position illustrated in FIG. 11, the sleeve nut 68 is barely tensioned, so grommet diameter is normal. Grommet 64 can slide fully within gauge channel 78 such that the grommet is positioned adjacent the starting index points 80. At this time, the sleeve nut 68 has barely been tensioned, so that grommet compression and screen tension are minimal. At the same time the suspension bracket 50 has been barely compressed by the carriage bolt fastener 60. The outermost portion of the convex carriage bolt head 61 will be spaced a distance "X1" from wall 38 as indicated in FIG. 10.

Figure 12:
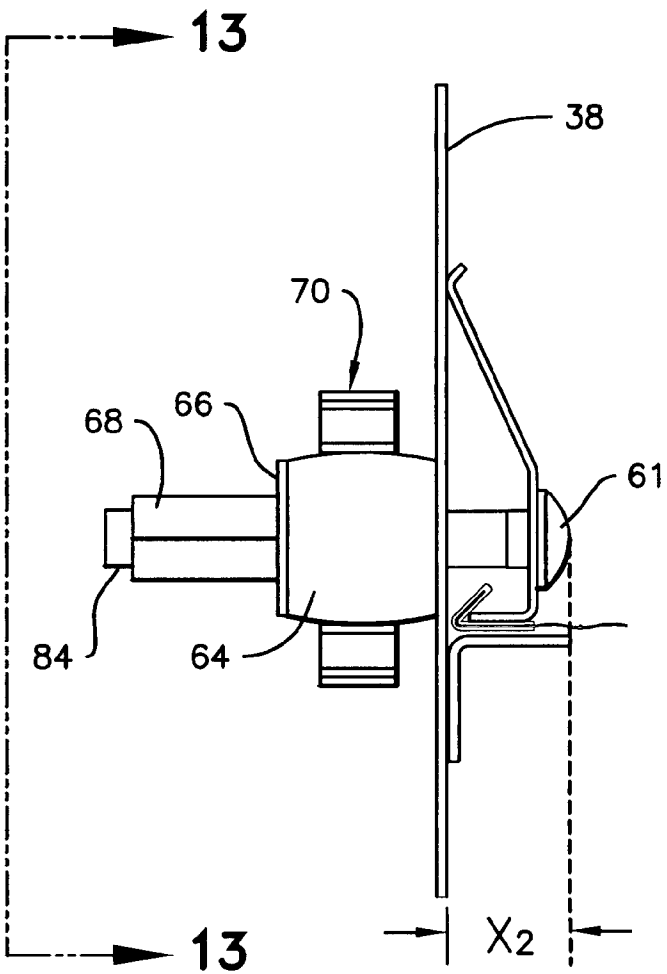
FIG. 12 is an enlarged, fragmentary plan view of a preferred tensioner set to an increased screen tension.
Figure 13:
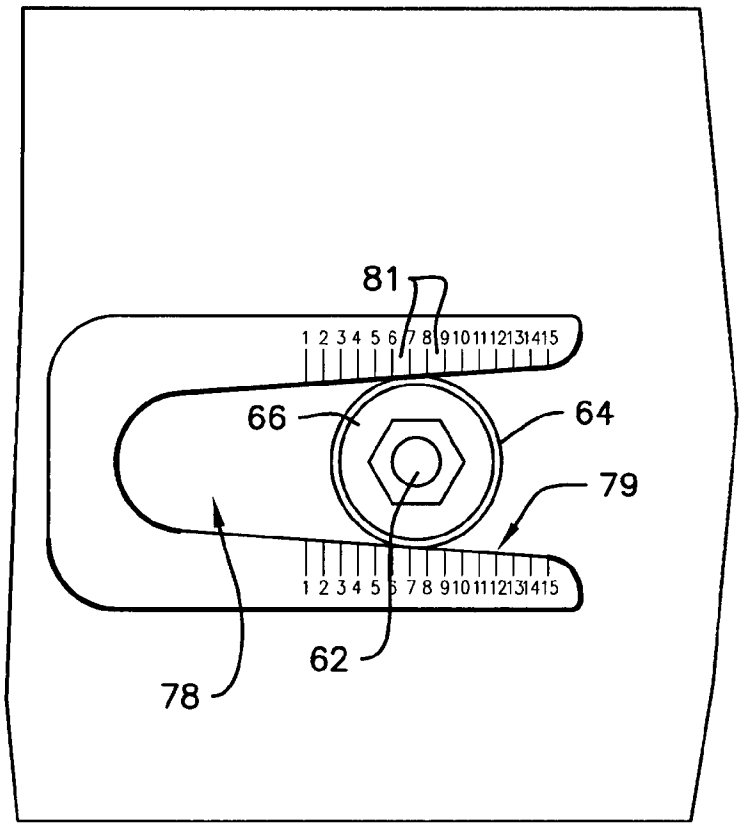
FIG. 13 is a fragmentary plan view taken generally along line 13-13 in FIG. 12.

FIGS. 12 and 13 show the positions of various components when the screen has been moderately tensioned. In this instance the gauge can be moved a lesser distance upon grommet 64, as the diameter of the compressed grommet has increased. The grommet 64 comes to rest within gauge channel 78 adjacent the intermediate indexing points 81, which correspond to an intermediate and desired operating tension for the screens. At this point the screen has been tensioned, and its edges have moved towards wall 38. Thus, as indicated in FIG. 12, distance "X2" that corresponds to the space between the carriage bolt head 61 and the subframe wall 38 has decreased (i.e., it is a smaller than distance "X1" in FIG. 10 discussed previously. Also apparent is the fact that tightening of sleeve nut 68 has drawn bolt 60 inwardly, such that a tip portion 84 is exposed.

Figure 14:
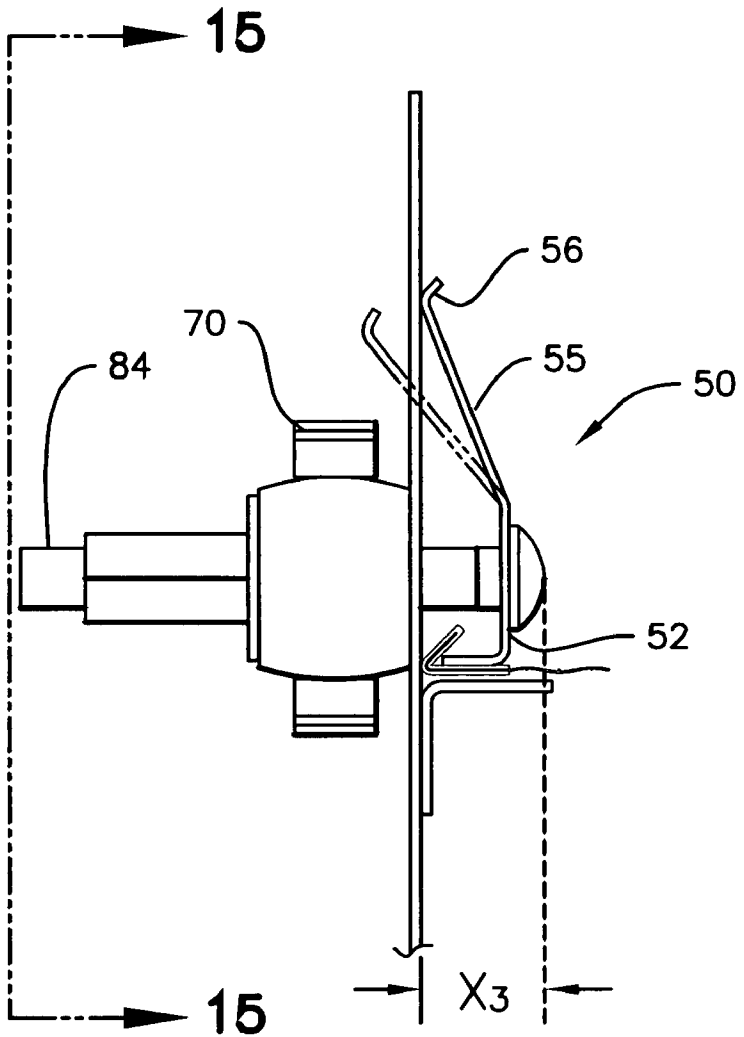
FIG. 14 is an enlarged, fragmentary plan view of a preferred tensioner set to a further increased screen tension.
Figure 15:
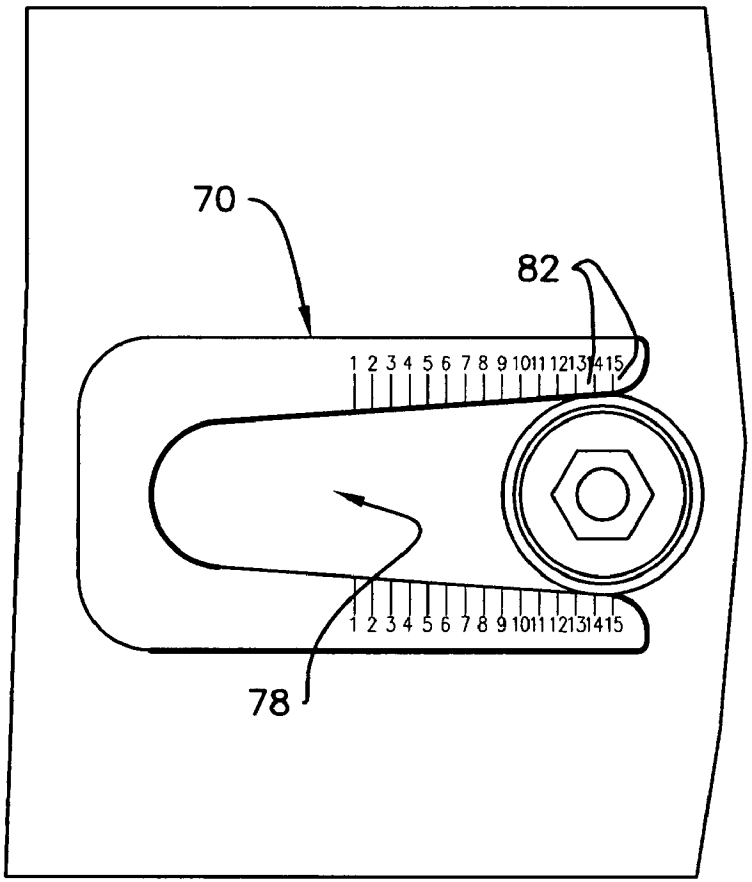
FIG. 15 is a fragmentary plan view taken generally along line 15-15 in FIG. 14.

Finally, FIGS. 14 and 15 illustrate maximum desired screen tension. Here the channel 78 in gauge 70 barely fits the compressed grommet 64, whose diameter has been substantially enlarged. Here grommet 64 comes to rest within gauge channel 78 adjacent the outermost indexing points 82, corresponding to maximal operating tension for the screens. This maximal screen tension results in a reduced distance "X3" (FIG. 14) that is smaller than either distance "X1" in FIG. 10 of distance "X2" in FIG. 12 discussed previously. It can also be seen that maximum tightening of sleeve nut 68 has drawn bolt 60 further inwardly, exposing more of tip portion 84.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A vibrating screen separator for separating commingled mixtures of aggregate solids, the separator comprising;

at least one screen subframe comprising a pair of spaced apart, rigid walls having exteriors and interiors;

a screen captivated between interiors of said walls, the screen having at least a pair of spaced apart edges;

means for vibrating the screen;

a tensioning system for mounting and tightening the screen, the tensioning system comprising:

suspension bracket means disposed on interiors of said walls for engaging the screen edges;

a plurality of spaced apart tensioners, each tensioner comprising an elongated fastener that extends through said suspension bracket means and through a subframe wall, a resilient, deformable grommet coaxially captivated upon said fastener at the wall exterior, and an adjustable nut threadably coupled to the fastener that compresses the grommet and tensions the screen when tightened; and, a gauge adapted to be fitted about the grommet to measure grommet deformation and thereby determine screen tension, the gauge comprising a top and a pair of legs with bottoms, the legs extending from the top and disposed on opposite sides of an elongated, generally U-shaped measurement channel that surrounds the grommet during measurement, the width of the channel being smallest proximate said top and widening towards the bottom of the legs, and a plurality of index points defined upon said legs proximate said channel that measure grommet diameter and correlate grommet diameter with screen tension.

2. The screen separator as defined in claim 1 wherein:

the suspension bracket means comprises a planar center integral with a lower, in-turned foot and an upper, angled arm;

edges of the screen are sandwiched within an elongated screen edge flange;

the bracket means foot forcibly engages the screen edge flange; and, the fastener deflects the bracket means to displace the screen edge flange and thus impart screen tension.

3. A tensioning system for mounting and tightening sifting screens mounted between rigid screen separator walls with inner and outer surfaces, the system comprising:

elongated screen edge flanges securing edges of the sifting screen(s);

suspension bracket means disposed on said inner walls for engaging said screen edge flanges, the suspension bracket means comprising a center integral with a lower foot engaging said screen edge flanges and an upper arm;

a plurality of spaced apart tensioners, each tensioner comprising:

an elongated bolt that extends through said suspension bracket means center and through said walls;

a resilient, deformable grommet coaxially captivated upon said bolt and forced against said outer wall surface; and, an adjustable nut threadably coupled to the bolt that tensions the bolt and compresses the grommet at an outer surface of the walls and tensions the screen when tightened by deflecting the suspension bracket means; and, a portable gauge adapted to be fitted about the grommet to measure grommet deformation to determine screen tension, the gauge comprising a top and a pair of legs with bottoms, the legs extending from the top and disposed on opposite sides of an elongated, generally U-shaped measurement channel that surrounds the grommet during measurement, the width of the channel being smallest proximate said top and widening towards the bottom of the legs, and a plurality of index points defined upon said legs proximate said channel that measure grommet diameter and correlate grommet diameter with screen tension.

* * * * *